US008550788B2

(12) United States Patent
Oda et al.

(10) Patent No.: US 8,550,788 B2
(45) Date of Patent: Oct. 8, 2013

(54) IMPELLER DEVICE AND MANUFACTURING METHOD FOR ROTARY IMPELLER

(75) Inventors: Shota Oda, Nagano (JP); Tetsuhiko Hara, Nagano (JP); Hideaki Ito, Nagano (JP)

(73) Assignee: Nidec Sankyo Corporation (JP)

( * ) Notice: Subject to any disclaimer, the term of this patent is extended or adjusted under 35 U.S.C. 154(b) by 582 days.

(21) Appl. No.: 12/711,311

(22) Filed: Feb. 24, 2010

(65) Prior Publication Data

US 2010/0215478 A1 Aug. 26, 2010

(30) Foreign Application Priority Data

Feb. 25, 2009 (JP) ..... 2009-042136

(51) Int. Cl.
*F01D 25/00* (2006.01)
*B23P 11/00* (2006.01)

(52) U.S. Cl.
USPC ..... 416/241 A; 416/61

(58) Field of Classification Search
USPC ..... 416/61, 146 R, 241 A
See application file for complete search history.

(56) References Cited

U.S. PATENT DOCUMENTS 4,056,748 A * 11/1977 Cross et al. ..... 310/168
6,012,339 A * 1/2000 Genack et al. ..... 73/861.77
6,400,050 B1 * 6/2002 Naman et al. ..... 310/68 B
2005/0081917 A1 * 4/2005 Bhatt et al. ..... 137/375

FOREIGN PATENT DOCUMENTS

JP 2005-163678 A 6/2005

* cited by examiner

*Primary Examiner* — Nathaniel Wiehe
*Assistant Examiner* — Joshua R Beebe
(74) *Attorney, Agent, or Firm* — Cantor Colburn LLP

(57) ABSTRACT

An impeller device may include a magnetic detecting element and a magnetic body, which is paired with the magnetic detecting element, for detecting a rotational position of a rotary impeller. The rotary impeller is formed with a bottomed recessed part having an opening into which one of the magnetic detecting element or the magnetic body is inserted, and the opening of the recessed part is sealed with resin injected by insert molding so that the one of the magnetic detecting element and the magnetic body is buried in the rotary impeller. The magnetic detecting element and the magnetic body are capable of facing to each other through a bottom face of the bottomed recessed part.

7 Claims, 6 Drawing Sheets

IMPELLER DEVICE AND MANUFACTURING METHOD FOR ROTARY IMPELLER

CROSS REFERENCE TO RELATED APPLICATION

The present invention claims priority under 35 U.S.C. §119 to Japanese Application No. 2009-42136 filed Feb. 25, 2009, the entire contents of which are incorporated herein by reference.

FIELD OF THE INVENTION

An embodiment of the present invention may relate to an impeller device and a manufacturing method for a rotary impeller. More specifically, an embodiment of the present invention may relate to an impeller device including a rotary impeller in which a magnetic detecting member such as a magnetic detecting element or a magnetic body is buried, and to a manufacturing method for the rotary impeller.

BACKGROUND OF THE INVENTION

For example, in Japanese Patent Laid-Open No. 2005-163678, in order to rotate a rotary impeller, which is rotatably supported, through a control of an external magnetic field, a rotor magnet is buried in the inside of the rotary impeller by insert molding. When insert molding is utilized, a rotor magnet which is inserted can be buried at a predetermined position accurately (positional accuracy is higher) and thus rotation of the rotary impeller can be controlled accurately.

The technique may be applied to a rotary impeller which is used, for example, to measure a flow rate of fluid flowing through a predetermined space. In other words, a magnet (magnetic body) which is paired with a magnetic detecting element for sensing magnetism is buried in the rotary impeller by insert molding to improve a measurement accuracy of a rotation number of the rotary impeller, i.e., a flow measurement accuracy of fluid.

However, when the rotary impeller in which a magnetic detecting member such as a magnet is buried is to be molded by insert molding described in the above-mentioned Patent Reference, an insert pin for supporting (positioning) the magnet and the like is required to advance and retreat to and from a die cavity and thus the die is complicated.

Further, in a case that insert molding is utilized, a hole left in a molded product after an insert pin for supporting the magnetic detecting member such as a magnet has been retreated from the cavity is usually buried by thermal fusion or potting in order to prevent the magnetic detecting member from being exposed to the outside. However, it is difficult to completely seal the hole having been left as a trace of the insert pin by thermal fusion or potting. Therefore, in a case of a rotary impeller which is used for flow measurement of food such as an automatic ice making device or a packaging process of a beverage, fluid may enter into the inside where the magnetic detecting member is buried and, when the magnetic detecting member is a magnet, the magnet may be corroded and it is hygienically undesirable. Further, when thermal fusion or potting is used, a gap space may be formed between the resin used to bury an opening and the magnetic detecting member and, in this case, the magnetic detecting member is rattled in the inside of the impeller. In a product in which rattling occurs, as described above, a distance between the magnetic detecting element and the magnetic body which affects detection accuracy of rotation for each product is not stabilized and thus detection accuracy of rotation is lowered.

SUMMARY OF THE INVENTION

In view of the problems described above, at least an embodiment of the present invention may advantageously provide an impeller device in which a die for molding where an insert pin is advanced and retreated is not used, in which a magnetic detecting member such as a magnetic body that is buried in the inside of the rotary impeller is prevented from rattling to secure a high degree of a detection accuracy and, in which a high degree of reliability is attained for sealing of the magnetic detecting member to be buried, and provide a manufacturing method for the rotary impeller.

According to at least an embodiment of the present invention, there may be provided an impeller device including a magnetic detecting element for detecting a rotational position of a rotary impeller, and a magnetic body which is paired with the magnetic detecting element for detecting the rotational position of the rotary impeller. The rotary impeller is formed with a bottomed recessed part having an opening into which one of the magnetic detecting element and the magnetic body is inserted, and the opening of the recessed part is sealed with resin which is provided by insert molding to bury the one of the magnetic detecting element and the magnetic body in the rotary impeller.

According to a rotary impeller in accordance with at least an embodiment of the present invention, one of a magnetic detecting element and a magnetic body (magnetic detecting member) is buried in the inside of the rotary impeller with a bottom face of the recessed part which is formed in the rotary impeller as a reference and thus positional accuracy of the buried magnetic detecting member is secured. Further, after the magnetic detecting member is inserted into the recessed part with the bottom face of the recessed part as the reference, the opening of the recessed part is closed with the resin which is injected under a high pressure by insert molding. Therefore, occurrence of a gap space between the resin injected in the opening and the magnetic detecting member is prevented and thus lowering of detection accuracy caused by rattling of the magnetic detecting member in the inside of the rotary impeller is restrained. In addition, the magnetic detecting member is surely sealed in the inside of the rotary impeller by insert molding. Therefore, corrosion of the magnetic detecting member due to entering of liquid or fluid is prevented and thus, even when used for flow measurement for food, for example, in an automatic ice making device, in a packaging process of a beverage or the like, a hygienic problem does not occur.

Specifically, it may be structured that the rotary impeller is rotatably supported in the inside of a fluid space formed in a case body, the case body includes a case main body which is formed with the fluid space and a cover body which is attached to the case main body for sealing the fluid space, the bottomed recessed part is formed toward a cover body side from a fluid space side, a magnet which is the magnetic body is sealed in the bottomed recessed part with the resin, and the magnet is capable of being faced to the magnetic detecting element which is held by the cover body through a bottom face of the bottomed recessed part. Further, in this case, it is preferable that a length of the magnet in a rotation axis direction of the rotary impeller is set to be smaller than a depth of the bottomed recessed part in the rotation axis direction. According to this structure, a part of the recessed part is left in a state that the magnet is abutted with the bottom face of the recessed part. Therefore, in this state, when the recessed part is sealed with resin, the magnet is surely sealed in the inside of the rotary impeller with the resin which is injected under a high pressure by insert molding.

Further, it is preferable that the rotary impeller is formed with blade parts on an outer wall in a radial direction of the rotary impeller, and the blade part and the recessed part are overlapped with each other in the rotation axis direction.

According to the structure as described above, the recessed part into which one of the magnetic detecting element and the magnetic body is inserted and the blade parts of the rotary impeller are formed to be overlapped with each other in the rotation axis direction. In other words, the recessed part is disposed on an inner side in the radial direction of the blade parts so that at least parts of the recessed part and the blade parts are overlapped with each other in the rotation axis direction. Therefore, a length of the rotary impeller in the rotation axis direction is made smaller. Accordingly, the size of the entire impeller device provided with the rotary impeller can be made smaller.

Further, according to at least an embodiment of the present invention, there may be provided a manufacturing method for a rotary impeller in which one of a magnetic detecting element and a magnetic body which is paired with the magnetic detecting element for detecting a rotational position is buried in an inside of the rotary impeller. The manufacturing method includes previously forming a bottomed recessed part in the rotary impeller toward the other of the magnetic detecting element and the magnetic body, inserting the one of the magnetic detecting element and the magnetic body into the bottomed recessed part, after that, injecting resin into the bottomed recessed part to seal an opening of the bottomed recessed part by insert molding, and burying the one of the magnetic detecting element and the magnetic body in the bottomed recessed part.

According to the manufacturing method for a rotary impeller as described above, one of the magnetic detecting element and the magnetic body which is buried in the rotary impeller is positioned with a bottom face of the recessed part which is formed in the rotary impeller as a reference. Therefore, a complicated die in which a support member such as an insert pin is used is not required and thus its manufacturing cost is suppressed. Further, the opening of the recessed part is sealed through injection of resin at the time of insert molding. Therefore, corrosion of the buried magnetic detecting member due to entering of liquid or fluid can be prevented, rattling of the magnetic detecting member in the inside of the rotary impeller is suppressed, and lowering of detection accuracy caused by rattling of the buried magnetic detecting member is restrained.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5(*a*) is an outward appearance view showing the rotary impeller which is viewed from a case main body side, and FIG. 5(*b*) is its outward appearance view which is viewed from a cover body side.

DETAILED DESCRIPTION OF THE PREFERRED EMBODIMENTS

Figure 1:
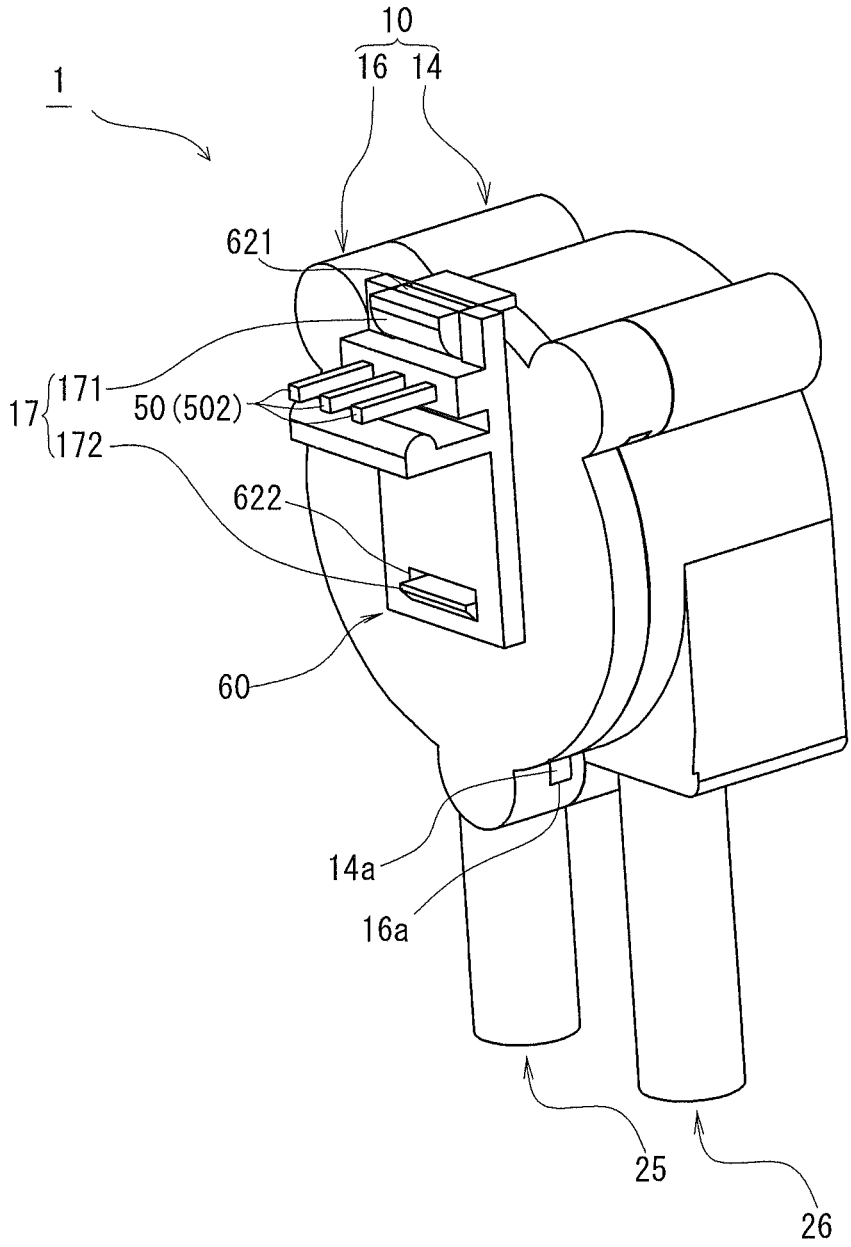
FIG. 1 is an outward appearance perspective view showing an impeller device in accordance with an embodiment of the present invention.
Figure 2:
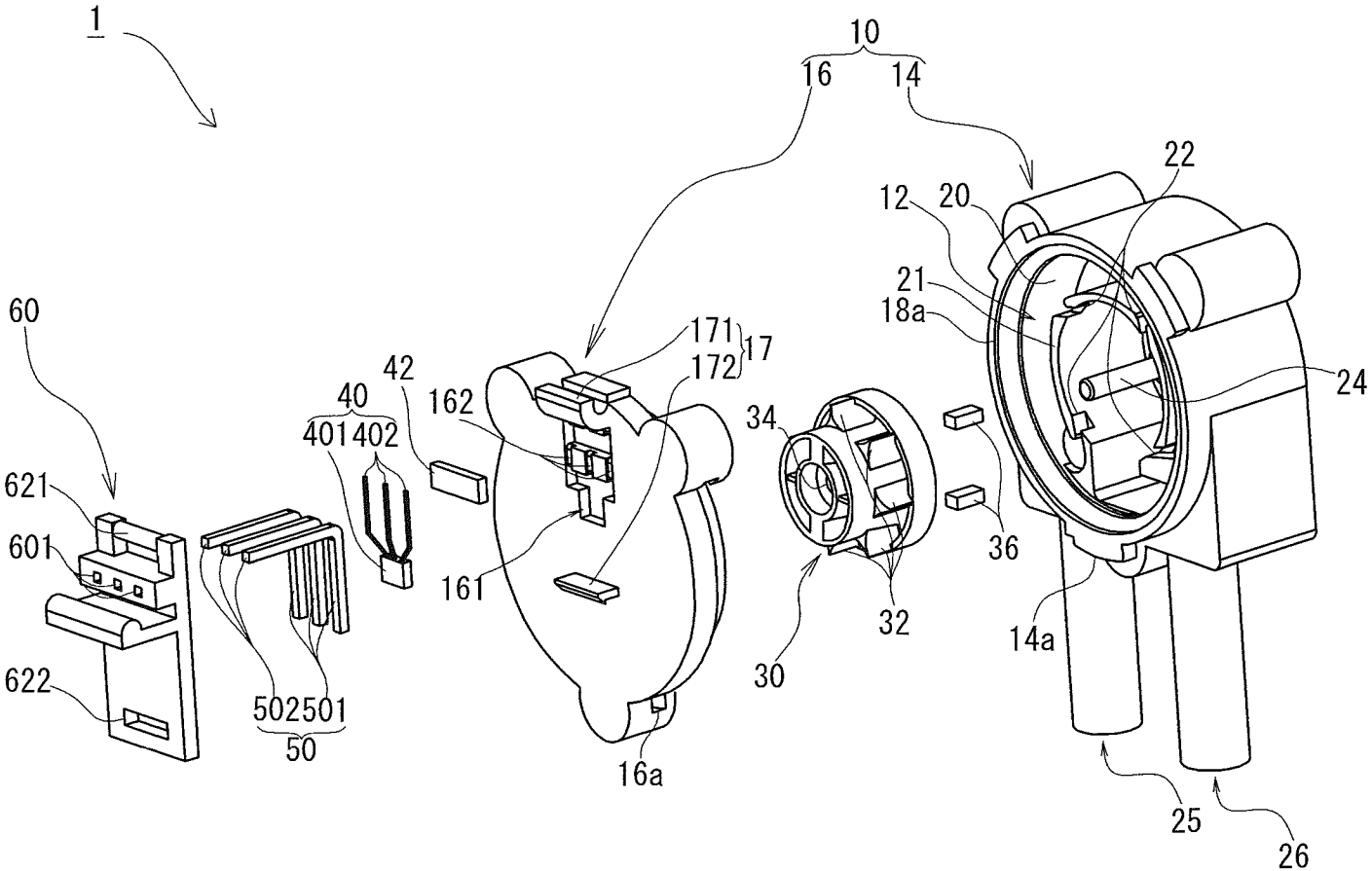
FIG. 2 is an exploded perspective view showing the impeller device in FIG. 1.
Figure 3:
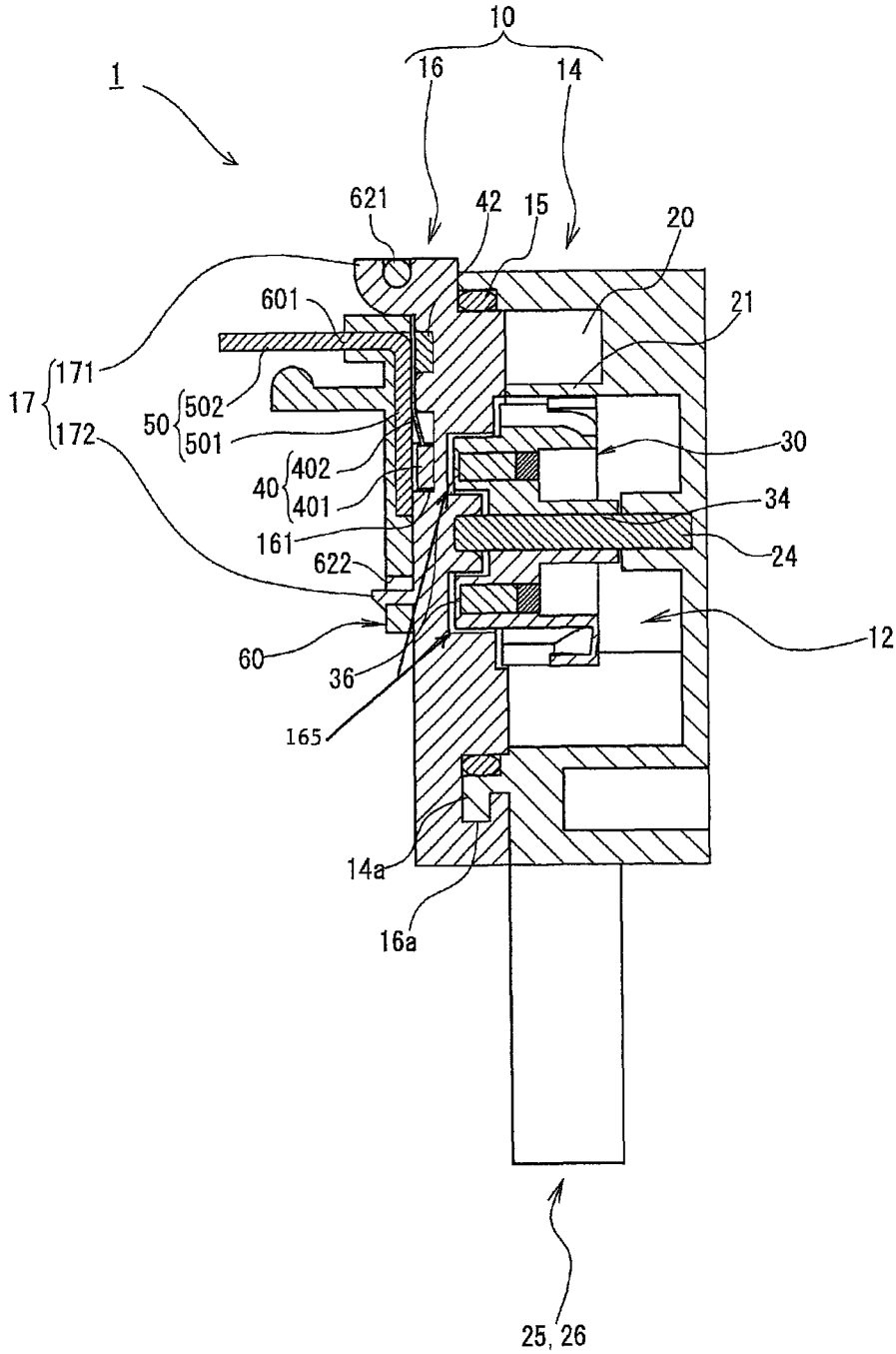
FIG. 3 is a cross-sectional view showing the impeller device in FIG. 1.
Figure 4:
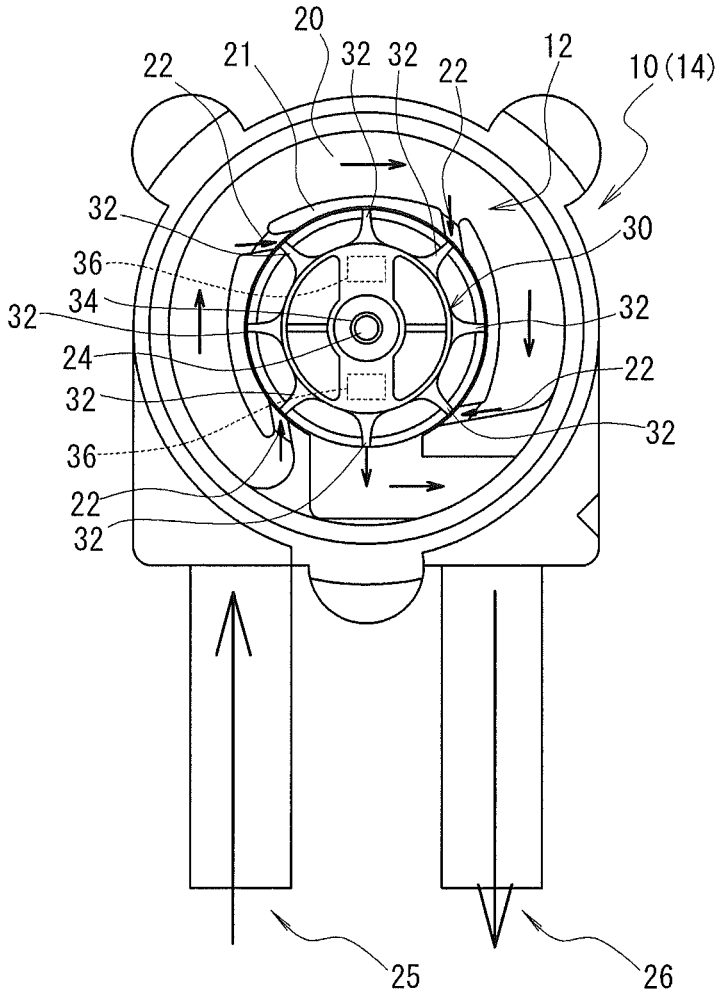
FIG. 4 is a plan view showing a state where a cover body is detached from the impeller device shown in FIG. 1 and schematically showing flow of fluid in a fluid space.

An impeller device in accordance with an embodiment of the present invention will be described in detail below with reference to the accompanying drawings. FIG. 1 is an outward appearance perspective view showing an impeller device 1 in accordance with an embodiment of the present invention, FIG. 2 is an exploded perspective view showing the impeller device 1, FIG. 3 is a cross-sectional view showing the impeller device 1, and FIG. 4 is a plan view showing a state where a cover body 16 is detached.

The impeller device 1 includes a rotary impeller 30 which is disposed in a fluid space 12 formed within a case body 10, a magnetic detecting element 40 for detecting a rotation number of the rotary impeller 30, and a magnetic body (magnet) 36 which is sensed by the magnetic detecting element 40. The impeller device 1 in accordance with this embodiment is a device which is capable of measuring a flow quantity of fluid by detecting a rotation number of the rotary impeller 30. The impeller device 1 is used to measure a flow quantity of food, for example, the impeller device 1 may be used for water supply into an ice making device, in a packaging process of a beverage or the like.

The case body 10 is structured of a case main body 14 and a cover body 16, both of which are made of resin. The case main body 14 is formed with a fluid space 12 which is a recessed portion having a predetermined size. A partition wall 21 is formed in the fluid space 12 for forming a flow passage 20 of fluid which is flown into the fluid space 12. In this embodiment, the partition wall 21 is formed with inflow passages 22. Further, an impeller shaft 24 which is a rotation axis of the rotary impeller 30 is protruded from a center of the fluid space 12, and a rotary impeller 30 is rotatably supported by the impeller shaft 24.

In addition, one side face of the case main body 14 is formed with an inflow port (inflow passage) 25 and an outflow port (outflow passage) 26 which are connected with the fluid space 12. After the rotary impeller 30 is fitted to the impeller shaft 24, the cover body 16 is attached to the case main body 14 and thus an opening 18*a* of the fluid space 12 is sealed. In this manner, the fluid space 12 is sealed up except the inflow port 25 and the outflow port 26.

An opposite face of the cover body 16 to the fluid space 12 is formed with a holder holding part 17 which is comprised of a first holder holding part 171 and a second holder holding part 172 on which a holder 60 is detachably mounted. A detailed shape of the holder holding part 17 and a detailed mounting structure of the holder 60 will be described below. A face of the cover body 16 facing the fluid space 12 is formed with a circular ring shaped recessed part 165. The circular ring shaped recessed part 165 is configured to receive the outer wall and the bottomed recessed part of the rotary impeller, as seen in FIG. 3.

In this embodiment, as shown in FIG. 3, an O-ring 15 is intervened between the case main body 14 and the cover body 16 in order to enhance air-tightness. Further, attachment of the cover body 16 to the case main body 14 is performed by means of that an engaging projection 14*a* of the case main body 14 is engaged with an engaging groove 16*a* of the cover body 16. In other words, in a state that the cover body 16 is abutted with the opening 18*a*, and the cover body 16 is turned and, in this manner, the engaging projection 14*a* is engaged with the engaging groove 16*a*. However, this structure is shown as an example and thus this structure may be modified appropriately.

Figure 5A:
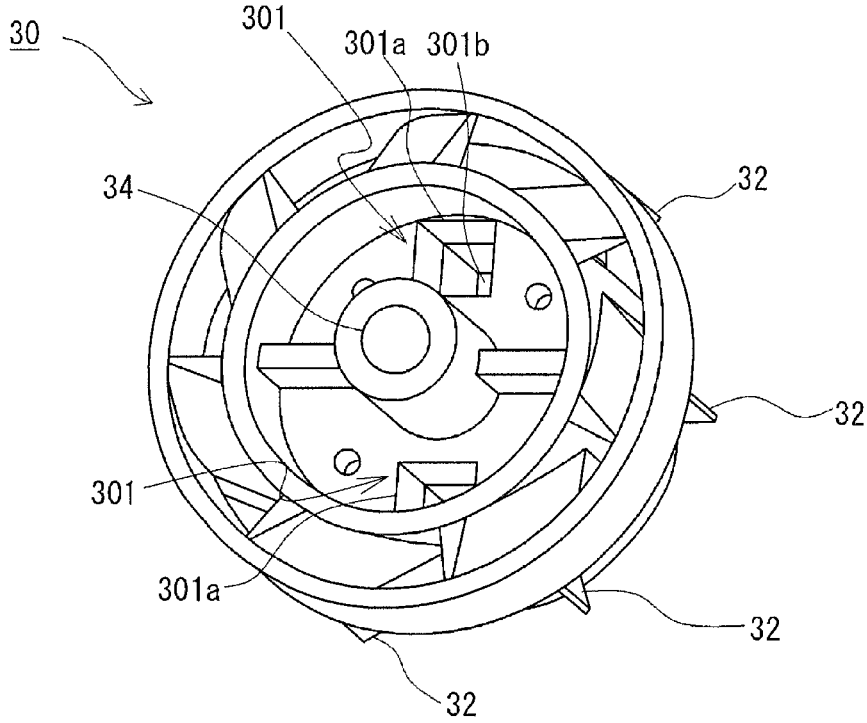
FIGS. 5(*a*) and 5(*b*) are outward appearance views showing a rotary impeller which is provided in the impeller device shown in FIG. 1.
Figure 5B:
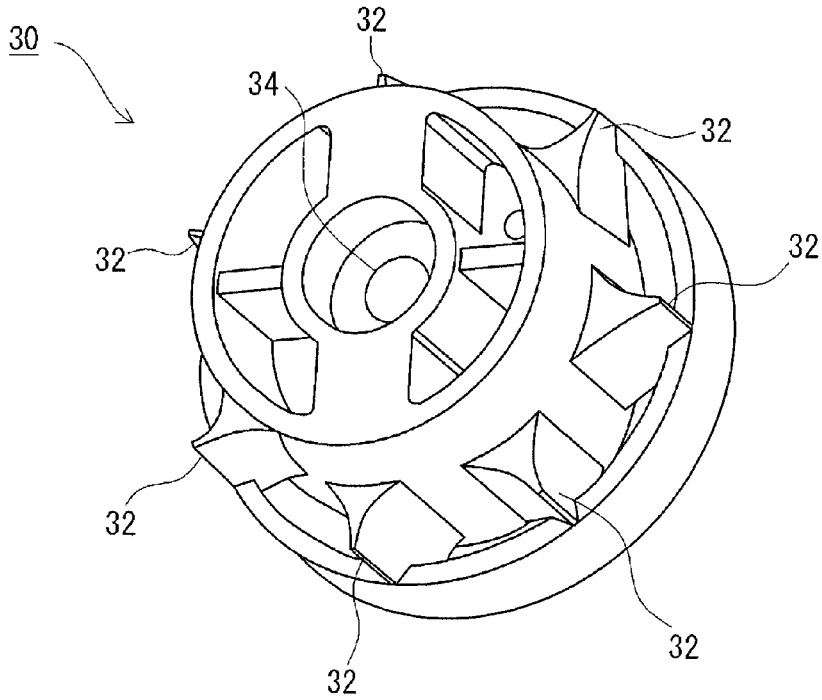
Figure 6:
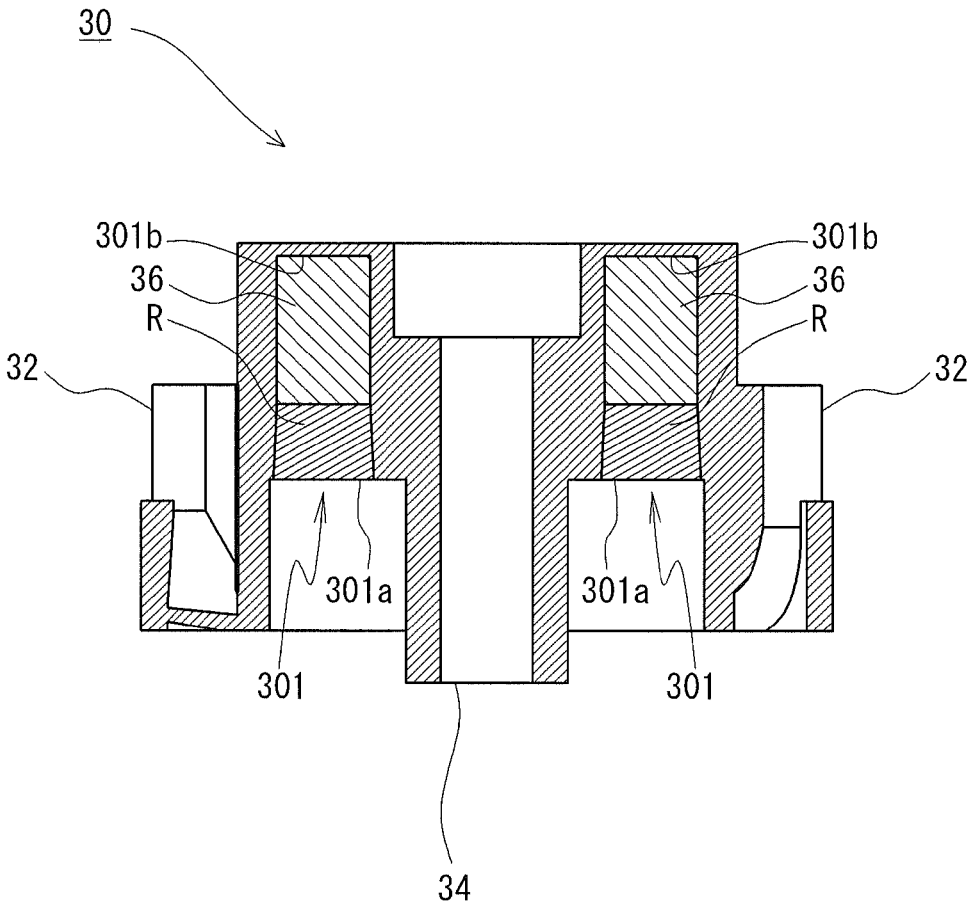
FIG. 6 is a cross-sectional view showing the rotary impeller in FIG. 5.

The rotary impeller 30 which is disposed within the fluid space 12 will be described in detail below with reference to FIGS. 5 and 6. FIG. 5(*a*) is an outward appearance view showing the rotary impeller 30 which is viewed from the case main body 14 side and FIG. 5(*b*) is its outward appearance view which is viewed from the cover body 16 side. Further, FIG. 6 is a cross-sectional view showing the rotary impeller 30. FIGS. 5(*a*) and 5(*b*) show states before the magnetic body (magnet) 36 is buried in the rotary impeller 30.

As shown in FIGS. 5(*a*) and 5(*b*) and FIG. 6, an outer peripheral face in a cylindrical shape of the rotary impeller 30 is formed with a plurality of blade parts 32. A bearing hole 34 is formed at the center of the rotary impeller 30 and an impeller shaft 24 is inserted into the bearing hole 34. In this manner, the rotary impeller 30 is rotatably supported within the fluid space 12. Further, a magnetic body (magnet) 36 is fixed to the rotary impeller 30. The magnetic body (magnet) 36 is fixed at two positions symmetrical with respect to a plane passing through a rotation axial line of the rotary impeller 30.

Specifically, as shown in FIG. 5(*a*), the rotary impeller 30 is formed with two recessed parts 301 which are opened (opening 301*a*) in a direction toward the case main body 14 side and formed in a bottomed shape (bottom face 301*b*). The recessed part 301 is formed so that its center axis or its direction is parallel to the rotation axis of the rotary impeller 30 and is disposed so as to be overlapped with a blade part 32 in a rotation axis direction of the rotary impeller 30. In other words, the recessed part 301 is disposed on an inner side of the blade part 32 in a radial direction of the rotary impeller 30 and thus a fluid space 12 side portion of the recessed part 301 and a cover body 16 side portion of the blade part 32 are formed so as to be overlapped with each other in the rotation axis direction of the rotary impeller 30. As a result, a length of the rotary impeller in the rotation axis direction is made smaller by a distance of overlapping of the fluid space 12 side portion of the recessed part 301 with the cover body 16 side portion of the blade part 32.

The magnetic body (magnet) 36 is buried into the rotary impeller 30 having a structure as described above as follows. In other words, the magnetic body (magnet) 36 is inserted into the recessed part 301 through the opening 301*a* which is located on a fluid space 12 side. As a result, one end of the magnetic body (magnet) 36 is abutted with the bottom face 301*b* of the recessed part 301. Next, the rotary impeller 30 into which the magnetic body (magnet) 36 is inserted is mounted on a molding die as an insert. A length of the magnetic body (magnet) 36 in the rotation axis direction the rotary impeller 30 is set to be smaller than a depth of the recessed part 301 in the rotation axis direction. Therefore, even in a state that the magnetic body (magnet) 36 is abutted with the bottom face 301*b* of the recessed part 301, a recessed part is left and formed on the opening 301*a* side of the magnetic body (magnet) 36 in the recessed part 301. Accordingly, resin "R" is injected into the recessed part 301 at the time of insert molding and the opening 301*a* of the recessed part 301 which is left on the fluid space 12 side is sealed with the resin "R". In this manner, the magnetic body (magnet) 36 is buried in the inside of the rotary impeller 30 and is sealed up by the impeller 30 and the resin "R". In this embodiment, an end face of the magnetic body (magnet) 36 is pressed against the bottom face 301*b* of the recessed part 301 by an injection pressure applied to the resin "R". Therefore, the end face of the magnetic body (magnet) 36 is firmly abutted with the bottom face 301*b* of the recessed part 301, and the magnetic body (magnet) 36 is fixed to the inside of the rotary impeller 30 in a completely sealed state by the insert molding. Further, since the resin "R" is injected under a high pressure, the resin "R" is entered into a gap space between the recessed part 301 and the magnetic body (magnet) 36 and thus lowering of detection accuracy due to rattling of the magnetic body (magnet) 36 in the inside of the impeller 30 is prevented.

As shown in FIG. 4, the rotary impeller 30 is rotated by means of that fluid pressures of fluids which are entered through the inflow passages 22 provided in the partition wall 21 are applied to the blade parts 32. Rotation of the rotary impeller 30 is detected by a magnetic detecting element 40.

The magnetic detecting element 40 is structured of a detecting main body 401 and terminals 402. The detecting main body 401 senses the magnetic bodies (magnet) 36 which are fixed to the rotary impeller 30 to convert them into an electric signal.

As shown in FIG. 3, the detecting main body 401 is disposed within a recessed part 161 which is formed on an opposite face of the cover body 16 (case body 10) to the fluid space 12 so that a distance between a center axis of the detecting main body 401 and a center axis of the impeller shaft 24 is equal to a distance between the center axis of the magnetic body (magnet) 36 and the center axis of the impeller shaft 24. Therefore, the magnetic body (magnet) 36 which is buried in the rotary impeller 30 faces the detecting main body 401 through the bottom face 301*b* of the recessed part 301 whose thickness is thin every time when the rotary impeller 30 is rotated by 180 degrees and the magnetic body (magnet) 36 is detected by the magnetic detecting element 40 at the facing position. A signal detecting the magnetic body (magnet) 36 is outputted to an outside control section for controlling the impeller device 1 and a rotation number of the rotary impeller 30, i.e., a flow quantity of fluid flowing through the fluid space 12 is measured.

Terminals 402 of the magnetic detecting element 40 are used to output the above-mentioned signal to the outside and, in this embodiment, the magnetic detecting element 40 is provided with three terminals 402, i.e., terminals for electric signal output, power supply and grounding.

The terminal 402 is abutted and electrically connected with the terminal pin 50. The terminal pin 50 is an "L"-shaped metal member which is comprised of a terminal contact part 501 and a connector part 502. The terminal contact part 501 is a portion which is abutted with the terminal 402 of the magnetic detecting element 40 as described below. The connector part 502 is a portion with which a connector not shown is connected for electrically connecting the impeller device 1 with the control section for the impeller device 1.

The terminal pin 50 is mounted in an abutted state with the terminal 402 of the magnetic detecting element 40 by the holder 60. The holder 60 is provided with a support shaft 621 as a support part, which is supported by a first holder holding part 171 formed in the cover body 16, and an engaging hole 622 as an engaging part which is engaged with a second holder holding part 172. The holder 60 is detachably mounted on the cover body 16 (case body 10). Further, the holder 60 is fixed with three terminal pins 50 which are electrically connected with three terminals 402 respectively. Specifically, the holder 60 is formed with three through holes 601 and the connector part 502 of the terminal pin 50 is press-fitted to each of the through holes 601 and thus the terminal pins 50 are fixed to the holder 60. As shown in FIGS. 1 and 3, the connector part 502 which is press-fitted into the through hole 601 is penetrated through the holder 60 to be protruded to the outside.

The first holder holding part 171 which is formed in the cover body 16 is, as shown in FIG. 3, formed in a "U"-shape in cross section which is opened in an upward direction. Further, the second holder holding part 172 is a pawl part which is capable of being elastically deformed. The holder 60 is attached to the cover body 16 (case body 10) by means of that the support shaft 621 is engaged with the first holder holding part 171 and the pawl part of the second holder holding part 172 is engaged with the engaging hole 622.

In this embodiment, an elastic sheet 42 formed of elastic material such as rubber is attached to a portion of the cover body 16 where the terminals 402 are placed. The terminals 402 are urged toward the terminal contact parts 501 by the elastic sheet 42. Therefore, contact of the terminals 402 with the terminal contact parts 501 are maintained surely and their electrically connected state is stabilized.

The impeller device 1 in accordance with an embodiment of the present invention which is structured as described above is provided with the following effects. In other words, the magnetic body (magnet) 36 is buried in the inside of the rotary impeller 30 with the bottom face 301*b* of the recessed part 301 formed in the rotary impeller 30 as a reference and thus its rattling is prevented. Therefore, a high degree of positional accuracy of the magnetic body (magnet) 36 is secured in the rotary impeller 30. Further, after the magnetic body (magnet) 36 is inserted so as to abut with the bottom face 301*b* of the recessed part 301, the opening of the recessed part 301 is closed with the resin injected under a high pressure which is applied at the time of insert molding. Therefore, a gap space is not formed between the resin injected into the opening and the magnetic body (magnet) 36 and thus lowering of a detection accuracy due to the rattling of the magnetic body (magnet) 36 in the inside of the rotary impeller 30 is prevented. In addition, the magnetic body (magnet) 36 is surely sealed in the inside of the rotary impeller 30 by insert molding, in other words, the magnetic body (magnet) 36 is sealed up by the impeller 30 and the resin "R" forming a seal R and thus corrosion of the magnetic body (magnet) 36 due to entering of liquid or fluid into the recessed part 301 is prevented.

In addition, as described above, the recessed part 301 is formed so that its center axis is parallel to the rotation axis of the rotary impeller 30. Further, the blade part 32 is formed so that its cross-sectional shape when cut by a plane perpendicular to the rotation shaft of the rotary impeller is constant. Therefore, the rotary impeller 30 which is provided in the impeller device 1 in accordance with this embodiment is not provided with a so-called undercut portion and thus the rotary impeller 30 can be formed by a simple die which is moved in the rotation axis direction without using a slide and the like.

Further, as described above, the recessed part 301 is formed so as to overlap with the blade part 32 in the rotation axis direction of the rotary impeller 30. Therefore, a length in the rotation axis direction of the rotary impeller 30 is made smaller by an overlapped length of the recessed part 301 with the blade part 32 and thus the entire size of the impeller device 1 which is provided with the rotary impeller can be made smaller.

Although the present invention has been shown and described with reference to a specific embodiment, various changes and modifications will be apparent to those skilled in the art from the teachings herein.

For example, in the embodiment described above, the magnetic body (magnet) 36 is buried into the rotary impeller 30. However, it may be structured that the magnetic detecting element 40 is buried into the rotary impeller 30 and the magnetic body (magnet) 36 is disposed at a position facing the magnetic detecting element 40.

Further, in the embodiment described above, two magnetic bodies (magnet) 36 buried in the rotary impeller 30 are sensed by one piece of the magnetic detecting element 40 which is fixed to the holder 60. However, these numbers may be appropriately increased or decreased. When a rotation number of the rotary impeller 30 is to be measured more accurately, these numbers may be increased.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An impeller device comprising:

a magnetic detecting element for detecting a rotational position of a rotary impeller;

a magnet which is paired with the magnetic detecting element for detecting the rotational position of the rotary impeller; and an impeller shaft for rotatably supporting the rotary impeller;

wherein the rotary impeller is rotatably supported in an inside of a fluid space formed in a case body;

wherein the case body includes a case main body which is formed with the fluid space and a cover body which is attached to the case main body for sealing the fluid space;

wherein the magnetic detecting element is held by the cover body;

wherein the rotary impeller is formed with a bottomed recessed part which is recessed toward a side of the magnetic detecting element so as to have an opening through which the magnet is inserted from an opposite side to the magnetic detecting element, and the opening of the recessed part is sealed with resin injected by insert molding so that the magnet is buried and sealed in the bottomed recessed part of the rotary impeller;

wherein the impeller shaft is supported by the case main body and the cover body;

wherein the rotary impeller is formed with blade parts on an outer wall in a radial direction of the rotary impeller and the outer wall is extended to a cover body side with respect to the blade parts; and wherein the cover body is provided with a circular ring shaped recessed part around the impeller shaft so that the outer wall and the bottomed recessed part of the rotary impeller are disposed in the circular ring shaped recessed part and, so that the magnet buried in the bottomed recessed part of the rotary impeller is disposed in the circular ring shaped recessed part of the cover body.

2. The impeller device according to claim 1, wherein the case body is provided with an inflow port and an outflow port which are in communication with the fluid space, and the rotary impeller is rotated by a fluid pressure of fluid which is entered from the inflow port.

3. The impeller device according to claim 1, wherein the blade part and the recessed part are overlapped with each other in a rotation axis direction of the rotary impeller.

4. The impeller device according to claim 1, wherein a length of the magnet in a rotation axis direction of the rotary impeller is set to be smaller than a depth of the recessed part in the rotation axis direction, and a recessed part which is formed in a state that the magnet is abutted with the bottom face of the recessed part is sealed with the resin.

5. The impeller device according to claim 4, wherein the rotary impeller is formed with blade parts on an outer wall in a radial direction of the rotary impeller, the recessed part is formed on an inner side of the blade parts in the radial direction, and the blade parts and the recessed part are overlapped with each other in the rotation axis direction of the rotary impeller.

6. A manufacturing method for an rotary impeller in which a magnet which is paired with a magnetic detecting element for detecting a rotational position of the rotary impeller that is buried in an inside of the rotary impeller, the manufacturing method comprising:

previously providing a case main body which is formed with fluid space and a cover body which is attached to the case main body for sealing the fluid space, and the rotary impeller is rotatably supported in an inside of the fluid space formed by the case main body and the cover body;

previously forming a bottomed recessed part in the rotary impeller which is recessed toward a side of the magnetic detecting element, previously forming the rotary impeller with blade parts on an outer wall in a radial direction of the rotary impeller and the outer wall is extended to a cover body side with respect to the blade parts;

previously forming the cover body with a circular ring shaped recessed part so that the outer wall and the bottomed recessed part of the rotary impeller are disposed in the circular ring shaped recessed part so that the magnet buried in the bottomed recessed part of the rotary impeller is disposed in the circular ring shaped recessed part;

inserting the magnet into the bottomed recessed part, after that, injecting resin into the bottomed recessed part to seal an opening of the bottomed recessed part by insert molding, and thereby burying the magnet in the bottomed recessed part so that the magnet faces the magnetic detecting element through a bottom face of the bottomed recessed part without interposing injected resin between the magnet and the bottom face of the bottomed recessed part.

7. The manufacturing method for an rotary impeller according to claim 6, wherein the case body is provided with an inflow port and an outflow port which are in communication with the fluid space, and the rotary impeller is rotated by a fluid pressure of fluid which is entered from the inflow port.

* * * * *